US006371244B2

(12) United States Patent
Okamura

(10) Patent No.: US 6,371,244 B2
(45) **Date of Patent: *Apr. 16, 2002**

(54) ESCAPE DEVICE

(76) Inventor: Toshio Okamura, 12, Yasui-cho 4-chome, Nishinomiya-shi, Hyogo-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/748,217

(22) Filed: Dec. 27, 2000

Related U.S. Application Data

(63) Continuation-in-part of application No. 08/402,498, filed on Mar. 13, 1995, now Pat. No. 6,182,789.

(51) Int. Cl.[7] ..... A62B 1/06

(52) U.S. Cl. ..... 182/72; 182/7; 182/231; 182/236; 74/425

(58) Field of Search ..... 182/7, 72, 231, 182/236; 74/425, 424.5, 424.7, 427, 606

(56) References Cited

U.S. PATENT DOCUMENTS

| | | | | |
|---|---|---|---|---|
| 339,918 A | | 4/1886 | Neilson | 182/236 |
| 2,561,832 A | | 7/1951 | Wilson | 182/72 |
| 2,680,593 A | | 6/1954 | McIntyre | 182/231 |
| 2,721,685 A | | 10/1955 | Frankel | 182/236 |
| 4,171,795 A | | 10/1979 | Bianchi | 182/236 |
| 4,422,493 A | * | 12/1983 | Forquer | 160/133 |
| 4,503,933 A | | 3/1985 | O'Neil | 182/231 |
| 4,643,040 A | * | 2/1987 | Adam et al. | 74/425 |
| 4,645,034 A | | 2/1987 | Griffith | 182/72 |
| 4,799,403 A | * | 1/1989 | Dinkel et al. | 74/788 |
| 5,346,158 A | * | 9/1994 | Epperson | 242/236 |
| 5,842,542 A | * | 12/1998 | Tien | 182/231 |
| 6,014,915 A | * | 1/2000 | Evans | 74/606 |
| 6,182,789 B1 | * | 2/2001 | Okamura | 182/7 |

FOREIGN PATENT DOCUMENTS

| | | |
|---|---|---|
| CA | 1113904 | 12/1981 |
| EP | 0087650 | 9/1983 |
| GB | 1440919 | 6/1976 |
| JP | 63-137370 | 6/1988 |

* cited by examiner

*Primary Examiner*—Bruce A. Lev
(74) *Attorney, Agent, or Firm*—Crowell & Moring LLP

(57) ABSTRACT

A worm gear mechanism driven by an electric motor and operatively coupled to a reel having a length of high tensile line for an emergency escape from a high structure. The reel is arranged within a casing, and a belt is connected to the casing for supporting a person's body. The worm gear mechanism rotates the reel, feeding out the line, and thereby lowering the user to a safe location below.

13 Claims, 5 Drawing Sheets

ESCAPE DEVICE

This application is a Continuation-in-Part application of application Ser. No. 08/402,498, filed Mar. 13, 1995 now U.S. Pat. No. 6,182,789.

BACKGROUND AND SUMMARY OF THE INVENTION

This invention relates to an escape device for escaping from a multi-storied building or other high area in an emergency comprising a worm gear mechanism driven by an electric motor, operatively coupled to a reel having a length of high tensile line wound around it, a casing enclosing operative components, and a belt connected to the casing for supporting a person's body.

In a previously known escape device, a speed reduction means such as a gear mechanism is mounted on a frame member which is attached to the exterior of a building with a thick rope connected to the gear mechanism. That device is expensive, heavy, and not easily portable. The escape height is limited due to the thickness of the rope.

Japanese Patent Publication No. 63-137370 discloses an escape device having a braking means including brake shoes, wedge members and handle levers operatively connected to a reel means having a long high tensile string attached, and having a belt member for supporting a person's body. In that invention, the descending person adjusts the braking force by operating the handle levers, which cause the wedge members and brake shoes to frictionally contact the string to reduce the descending speed. The braking force is unstable due to differences in body weight of descending persons and due to varying friction characteristics of the brake shoes. It is also difficult to operate the handle levers while descending. That invention presents problems with quality control and safety control.

In another previously known escape device, a rope of about 5.0 mm in diameter is used with speed reduction means utilizing the viscosity of silicon oil. That invention has an unstable braking force due to variations in the viscosity of the silicon oil. The escape height of that invention is limited due to the thick rope used. It is also large, heavy, and expensive.

The object of the present invention is to provide an escape device which has an easily controlled descending speed and which is portable and economical.

This object has been achieved according to the present invention by providing an escape device comprising a worm gear mechanism driven by an electric motor, operatively coupled to a reel, with a line wound around the reel. These components are contained within a casing which has a belt means attached to support a person's body. In the case of an emergency in which one needs to escape from a building, the user attaches himself to the escape device by using the belt means. Then the user attaches the end of the line, which may have a hook connected to it, to a fixture of the building, such as a door knob, window frame, bed or other furniture, faucet, etc. The user then may climb out of a window or other opening and lower himself to the ground or a safe place below by operating the escape device. The user grasps the escape device by placing each hand through hand holes in the casing. The user controls his descent by operating a main switch on the exterior of the casing which operates the electric motor. The electric motor turns the worm gear mechanism which turns the reel, feeding the line out from the reel and thereby lowering the user toward the ground or a safe place below. The line is attached to the reel, and the worm gear mechanism has a locking function, so that in the case of the line length being less than the escape height, the user will not drop off the end of the line. Although the present invention is primarily intended for use by people, it may also be used or adapted to lower pets or valuables from a high area in an emergency.

Any line length may be used, for example, 10–300 meters. The line is preferably a high tensile steel such as piano wire, or a high tensile plastic material such as carbon fiber. The line preferably has a tensile strength, $\sigma \geqq 100$ kgf/mm$^2$, and more preferably, $\sigma \geqq 150$ kgf/mm$^2$. The tensile strength, F, of the line, must be greater than the user's body weight. The diameter or section area of the line is selected based on $\sigma$ and F. The line may be single strand or multiple strands.

The electric motor and in turn the worm gear mechanism rotate at a constant speed, so users of varying weights descend at the same speed, for example 1.0–3.0 meters/second. The diameter of the wound line decreases as the line is fed out from the reel, resulting in a decreasing descending speed as more line is fed out from the reel. This has the benefit of slowing the rate of descent as the user nears the ground. To obtain a constant descending speed, or to vary the descending speed, an electric motor with a variable output may be used. The electric motor preferably is reversible so that in the case that too much line is fed out, the electric motor can be reversed to tighten up the slack by winding the excess line around the reel. The electric motor is preferably driven by direct current from a battery.

In one preferred embodiment of the present invention, the escape device is constructed in a compact and lightweight manner so that it is portable, so that it may be easily carried by travelers in their luggage, stored by office workers in their desks, or stored by a hotel in each of the rooms. In this regard, a worm gear mechanism which has a large speed reduction ratio is used, requiring a less powerful electric motor, thereby allowing the electric motor and battery to be smaller. A line having a high tensile strength is used to reduce the size and weight of the device.

In another embodiment of the present invention, the escape device may be constructed in a heavy-duty manner, using heavier and bulkier materials and components. This embodiment may be applicable for permanent mounting to a building such as a hotel. In this embodiment, the reel may be enlarged to be a drum, so that the line can be substantially lengthened.

In certain preferred embodiments the reel assembly includes a pair of disk plates and a reel shaft which are integrally made with metal or plastic material. The worm wheel member is fixed to the reel by adhesive bonding with adhesives to one of the disk plates of the reel. According to further preferred improvements of this embodiment, the worm wheel member has a plurality of boss portions inserted into indents in the disk plate which is attached. The worm wheel member is made from either metal or synthetic plastic material. The shaft of the reel can be bearingly supported in through openings in a casing housing and casing cover of the casing.

Other embodiments of the invention provide for a reel assembly with a pair of disk plates and shaft made integrally with metal or plastic material. The casing includes a short cylindrical bore that does not extend through the casing housing, which short cylindrical bore accommodates the reel, without directly supporting the shaft of the reel at the casing. The diameter of this cylindrical bore in the casing corresponds closely with that of the reel outer diameter and the width of the bore is substantially the same as that of the reel and worm wheel member. With this arrangement, the reel is supported by the inner circumferential surface and inner side and surface of the cylindrical bore of the casing.

Certain preferred embodiments of the invention, the high tensile string or line member is made of strong thin tape made of plastic material and/or carbon fiber material.

Other objects, advantages and novel features of the present invention will become apparent from the following detailed description of the invention when considered in conjunction with the accompanying drawings.

DETAILED DESCRIPTION OF THE DRAWINGS

Figure 1:
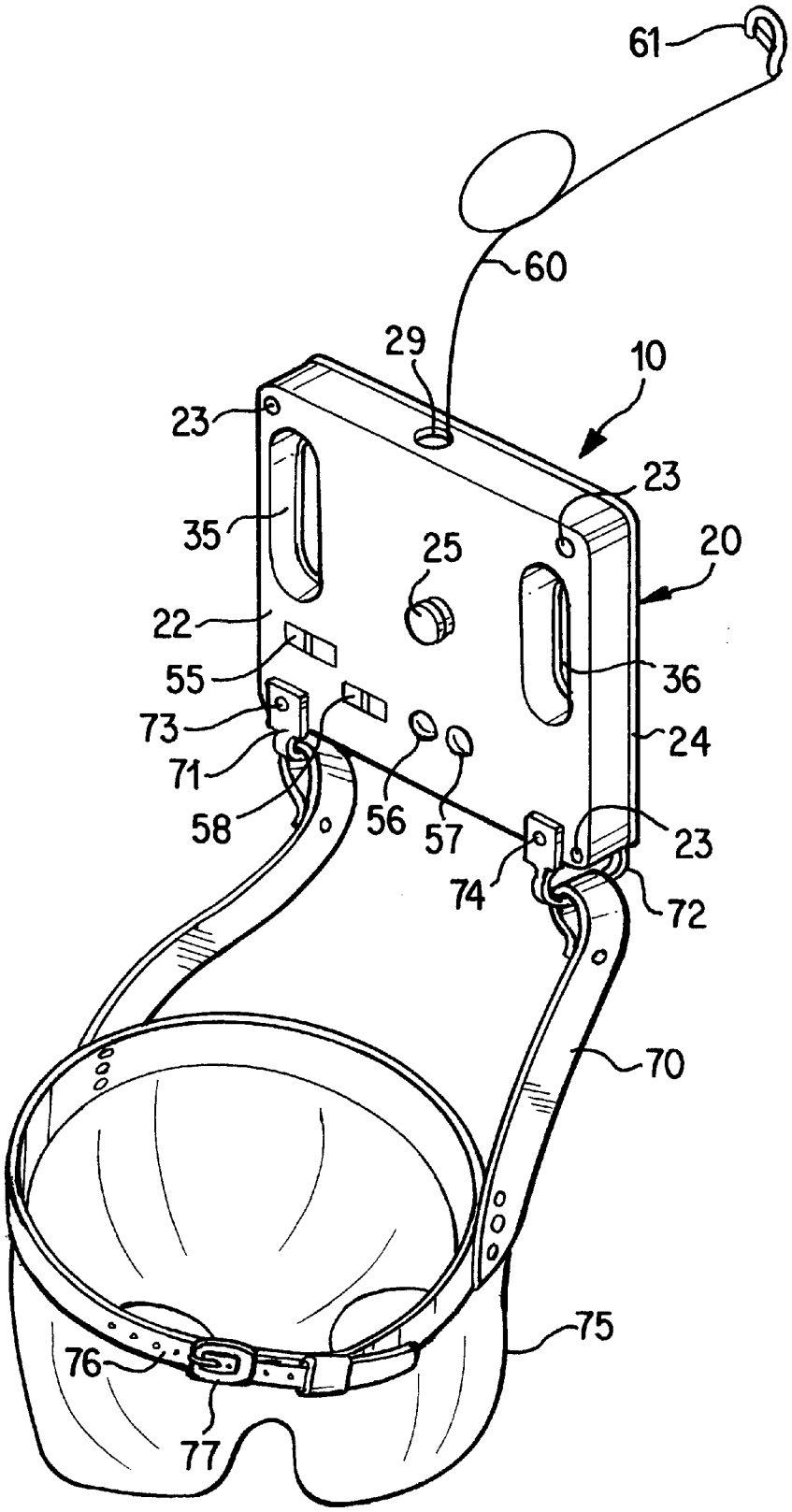
FIG. 1 shows an exterior view of an escape device.

In FIG. 1, an exterior view of an escape device 10 is shown with a casing 20 comprising a casing main body 22, a casing lid 24, and hand holes 35, 36. Screws 23 attach the casing main body 22 to the casing lid 21. A shaft member 25 is fixed to the casing 20. A main switch 55, a battery test switch 58, a light emitting diode 56 for indicating rotation of the motor, and a light emitting diode 57 for checking the battery are mounted at the surface of the casing main body 22. A line 60 extends through a line opening 29 and has a hook member 61 attached proximate its end.

A belt 76 is coupled to the casing 20 with belt members 70, belt supporting members 71, 72 and pins 73, 74 which extend through the casing 20. A short pair of pants 75 constructed of a strong material is attached to the belt 76. To use the escape device, the user puts on the short pair of pants 75 and fastens the belt 76 using a belt buckle 77, attaches the line 60 to a fixture of the building by using the hook 61 or by typing, grasps the escape device with both hands through the hand holes 35 and 36, climbs out of a window or other opening, and turns on the main switch 55 to lower himself to the ground or a safe location below.

Figure 2:
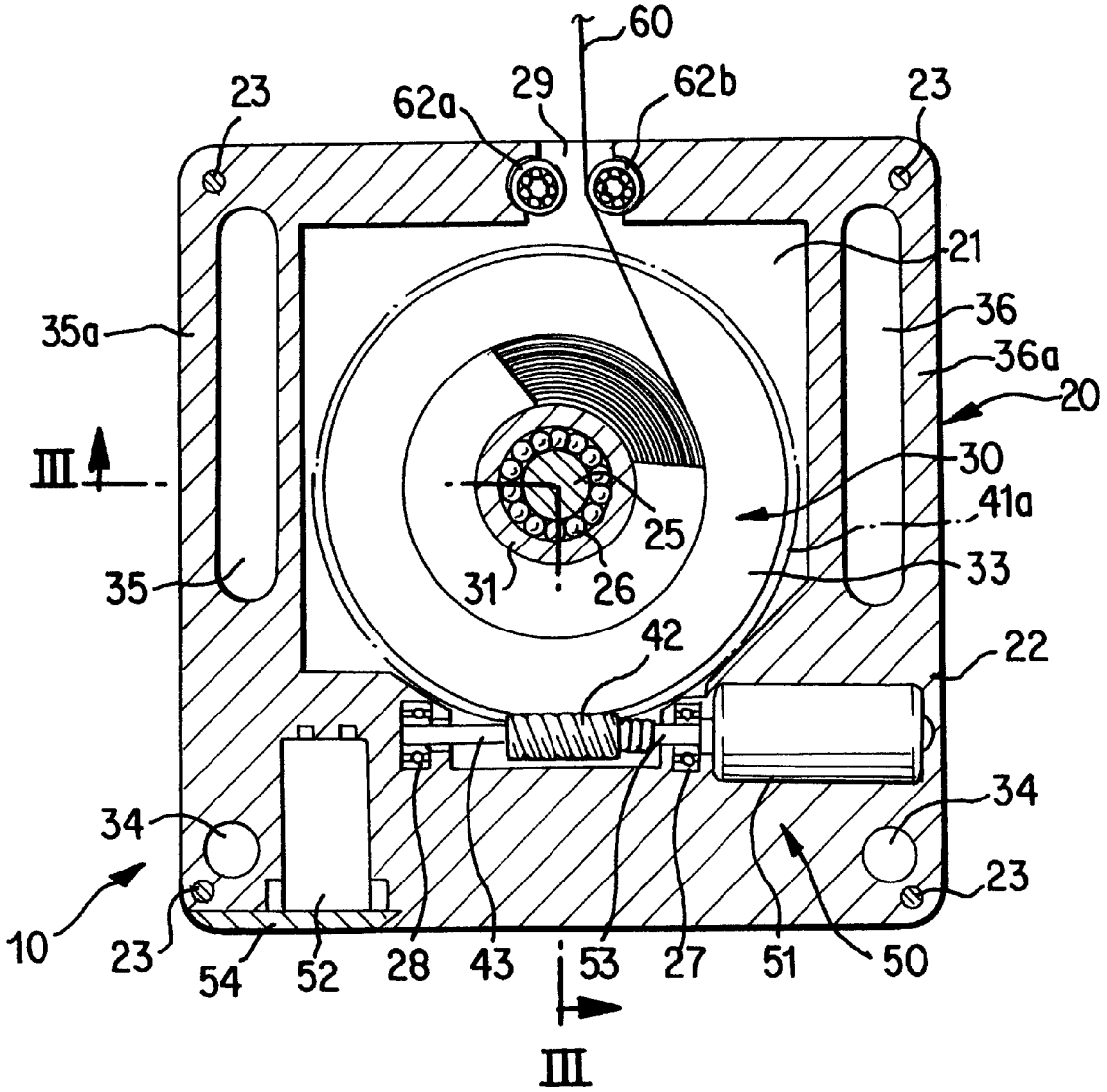
FIG. 2 shows a cut-away frontal interior view of the escape device of FIG. 1.

In FIG. 2, a cutaway interior view of the escape device 10 is illustrated having a worm gear mechanism 40 comprising a worm gear 42 and a worm gear shaft 43, coupled to an output shaft 53 of an electric motor 51, which is driven by direct current from a battery 52. A reel 30 comprising circular plates 32, 33 fixed to a sleeve 31, is rotatably mounted on a shaft member 25 by means of a ball bearing 26. A circumferential edge of circular plate 32 comprises worm wheel teeth 41*a* which operatively interact with worm gear 42. A high tensile line 60 is wound around the reel 30. The electric motor 51 turns the worm gear 42 which interacts with the worm wheel teeth 41*a* to turn the reel 30, feeding the line 60 out from the reel. Guide rollers 62*a*, 62*b* guide the line as it is fed out the line opening 29.

FIG. 2 further shows that the above-mentioned components are housed in the casing 20 which may be formed of light metal such as aluminum or titanium or of a light alloy metal such as aluminum alloy or titanium alloy or of a plastic material. The hand holes 35, 36 provide gripping area 35*a*, 36*a* for grasping the escape device with both hands. The casing main body 22 further comprises a space 21 for containing the reel, pin holes 34, and a slidable lid 54 for changing the battery.

Figure 3:
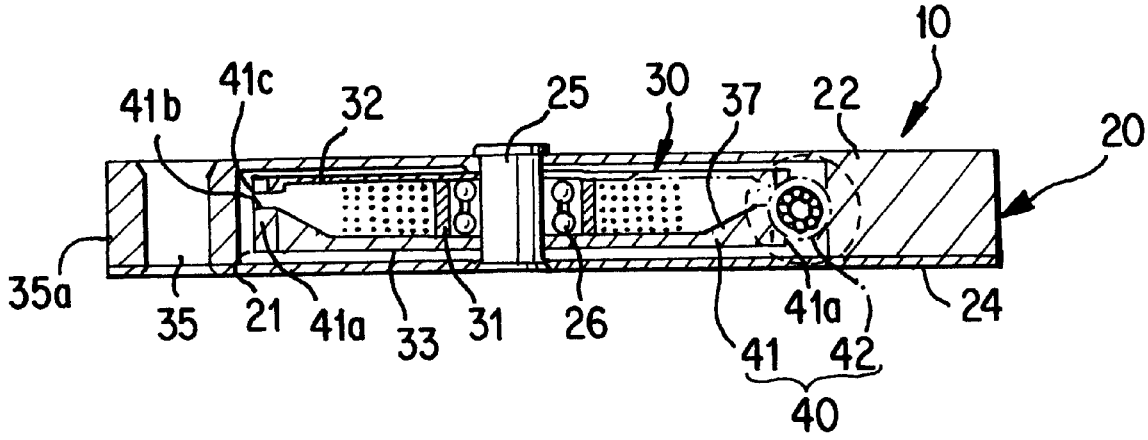
FIG. 3 shows a cutaway side view of the escape device of FIG. 1.

In FIG. 3, a cutaway view of the side of the escape device shows the reel 30 comprising circular plates 32, 33 and sleeve 31 mounted to the shaft member 25 by means of bearing 26. The shaft member 25 is fixed to the casing 20 comprising casing main body 22 and casing lid 24. The worm gear 42 operatively interacts with worm wheel teeth 41*a* formed at a thick portion 37 of circular plate 33. In this embodiment, the circular plate 33 forms the worm wheel 41. The circumferential inner edges 41*b*, 41*c* of the circular plates 32, 33 are rounded to protect the line as it is fed out from the reel.

Figure 4:
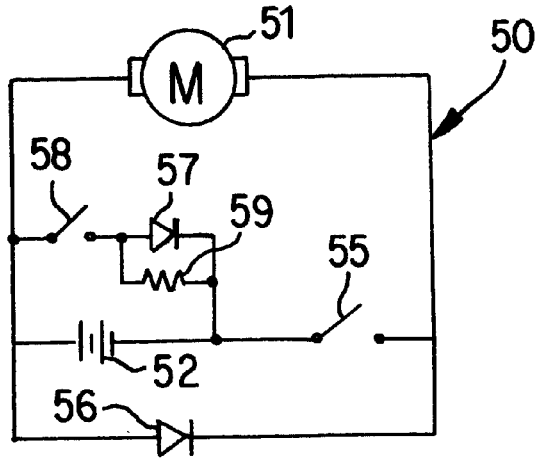
FIG. 4 shows the electrical circuit diagram for the escape device of FIG. 1.

In FIG. 4, the electrical circuit diagram 50 of the escape device shows the electric motor 51 connected to a battery 52 in a circuit having a main switch 55. A light emitting diode 56 for indicating rotation of the motor is connected with the battery 52 in parallel with the motor. A light emitting diode 57 for checking the battery in parallel with a resistor 59 is connected to the battery 52 in a circuit having a battery test switch 58.

Figure 5:
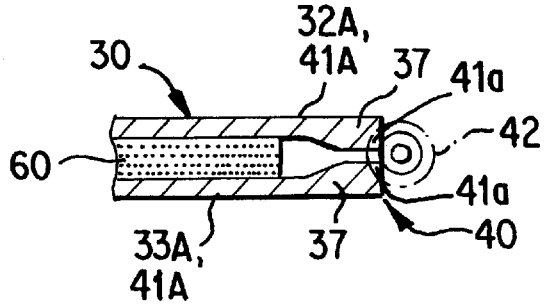
FIGS. 5, 6, and 7 show variations in the worm gear mechanism of the escape device of FIG. 1.
Figure 6:
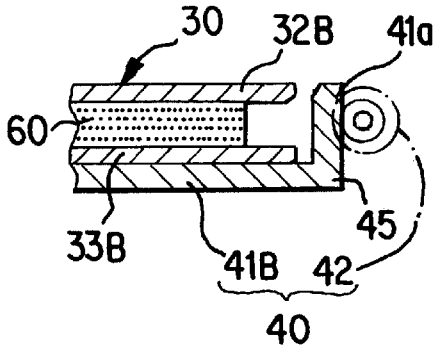
Figure 7:
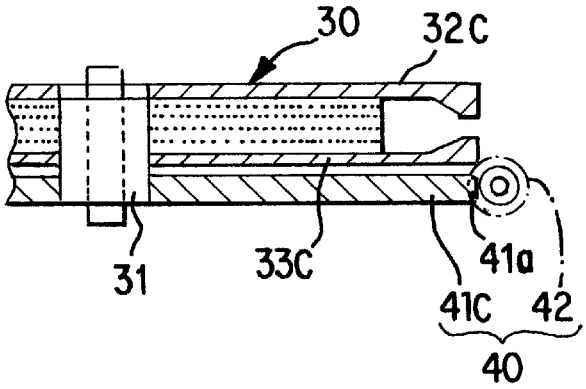

FIGS. 5, 6, and 7 show variations in the worm gear mechanism 40. In FIG. 5, the worm gear 42 operatively interacts with worm gear teeth 41*a* formed in thick portions 37 at the circumferential edge of circular plates 32A, 33A. In this case the circular plates 32A, 33A form worm wheels 41A. In FIG. 6, the worm gear 42 operatively interacts with worm gear teeth 41*a* formed in a lateral extension 45 from a circumferential edge of a worm wheel 41B which is fixed to the circular plate 33B of the reef formed by plates 32B and 33B. In FIG. 7, the worm gear 42 operatively interacts with worm gear teeth 41A formed at a circumferential edge of a worm wheel 41C which is fixed to the sleeve 31. In FIG. 7, the reel is formed by plates 32C and 33C.

Figure 8:
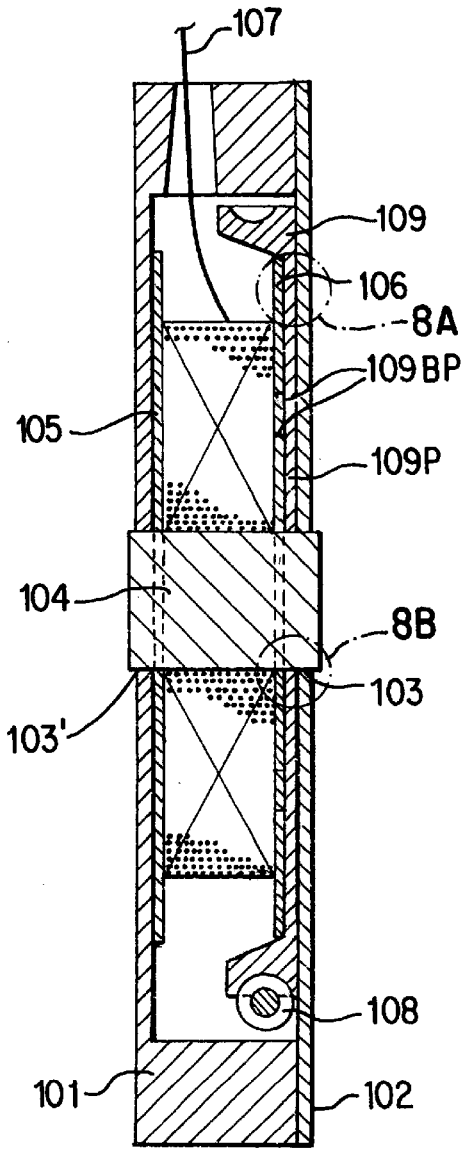
FIG. 8 is a schematic sectional view showing a casing and reel assembly constructed according to another preferred embodiment of the present invention.
Figure 8A:
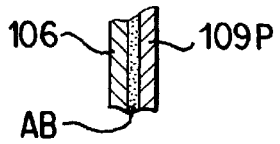
FIG. 8A is an enlarged view of section A of FIG. 8.
Figure 8B:
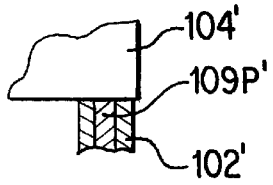
FIG. 8B is a view of section B of FIG. 8 showing a modified arrangement using plastic material.

FIG. 8 shows another preferred embodiment of the worm gear mechanism and casing therefor. A casing housing 101 covered by a casing cover 102 forms an enclosure for a reel assembly which is supported by its shaft 104 in through bores 103 and 103' of the casing housing 101 and casing cover 102. The reel assembly includes a first disk plate 105 and a second disk plate 106 which are fixed to and integrally formed with the shaft 104. The high tensile line 107 is wound on the shaft 104 intermediate the plates 105 and 106. In certain preferred embodiments, the integrally formed reel assembly including the shaft 104 and the plates 105 and 106 is formed of metal as shown in FIG. 8; in other preferred embodiments it is formed of plastic synthetic material as shown in FIG. 8B. The worm wheel drive includes a worm gear 108 which is drivingly engaged with an annular worm wheel member 109. The worm wheel member 109 includes a plate section 109P which is disk shaped and essentially surrounds the disk plate 106. When assembled, the disk plate 106 is bonded to the worm wheel member plate 109P by an adhesive bond utilizing epoxy adhesives or polyimide adhesives or the like. Boss portion 109BP in the worm wheel member plate 109P interengage with indentations in the disk plate 106. Preferred embodiments of the worm wheel member and its plate are made of metal, and other preferred embodiments are made of synthetic plastic material.

Figure 9:
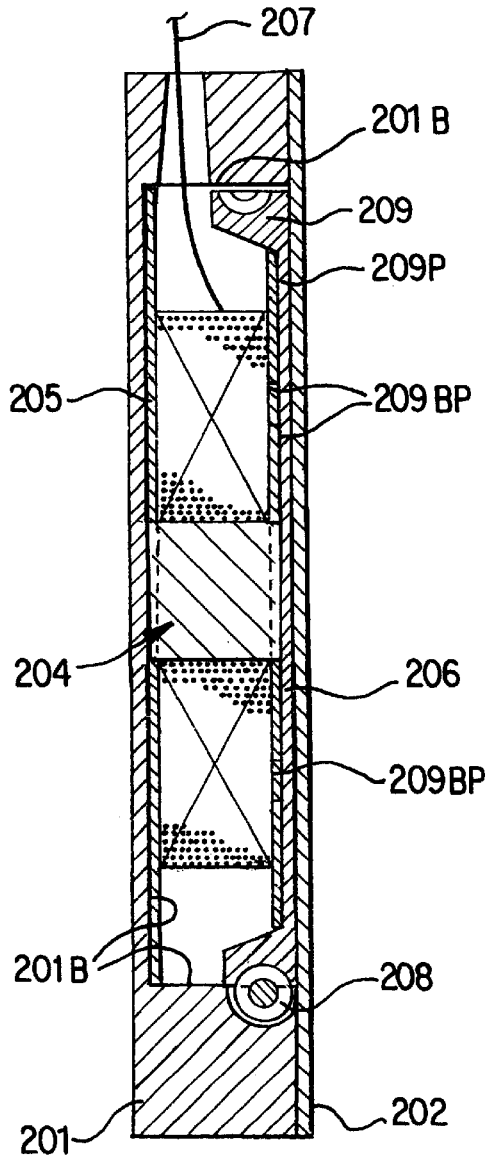
FIG. 9 is a view similar to FIG. 8, showing yet another reel assembly and casing configuration.

Preferred embodiments of the arrangement of FIG. 9 provide for boss portions 209BP in the worm wheel member plate 209P, which inter engage with indentations in the plate disk 206 of the reel assembly. Also, the worm wheel member 209, 209P is adhered by adhesives to the plate 206 and is driven by worm gear 208.

This arrangement of FIG. 8 is especially advantageous insofar as manufacturing ease and cost of assembly and materials are concerned.

The FIG. 9 embodiment includes a casing housing 201 covered by a casing cover 202, which together form an enclosure for the reel assembly comprising a reel shaft 204 which carries a winding of a line 207 intermediate to plates 205 and 206. The reel assembly including the disk plates 205 and 206, as well as the shaft 204 are integrally formed of metal or plastic material. In contrast to the arrangement of FIG. 8, the casing housing 201 and cover 202 do not include through bores, but rather the reel is supported in a cylindrical bore 201B of the casing housing 201. The cylindrical bore suggests the worm wheel member 209 with its plate 209P, as well as the facing reel assembly plate 205 by way of the circumferential bore 201B. Preferred embodiments of the arrangement of FIG. 9 provide for boss portions 209BP in the worm wheel member plate 209P, which inter engage with indentations in the plate disk 206 of the reel assembly. Also, the worm wheel member 209, 209P is adhered by adhesives to the plate 206.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. An escape device comprising:

a casing;

a supporting member coupled to said casing for supporting a user;

a reel supported by said casing;

a line wound on said reel;

a worm gear mechanism supported by said casing; and a drive motor operatively coupled to said worm gear mechanism for affecting a rotation of the worm gear mechanism, said worm gear mechanism being operatively coupled to said reel such that said rotation of the worm gear mechanism rotates the reel to unwind the line, wherein the casing includes a casing housing part and a casing cover part, and wherein the reel includes first and second disk plates integrally formed with a reel shaft which in use is supported in the casing.

2. An escape device according to claim 1, wherein the casing housing part and casing cover part have respective aligned through bores which support the reel shaft protruding therethrough when in an in use assembled position.

3. An escape device according to claim 2, wherein the worm gear mechanism includes:

a worm wheel member which is coaxial with the reel when in an in assembled position, and a worm gear engageable with the worm wheel member to rotate the worm wheel member relative to the casing.

4. An escape device according to claim 3, wherein the worm wheel member includes a worm wheel plate member which is bonded to the first disk plate.

5. An escape device according to claim 4, wherein the worm wheel member has plural boss portions engageable in indentations in the first disk plate.

6. An escape device according to claim 3, wherein the worm wheel member has plural boss portions engageable in indentations in the first disk plate.

7. An escape device according to claim 6, wherein the first disk plate is bonded to the worm wheel member by an adhesive bond.

8. An escape device according to claim 2, wherein the worm wheel member is made of metal.

9. An escape device according to claim 2, wherein the worm wheel member is made of plastic.

10. An escape device according to claim 1, wherein the disk plates and reel shaft are formed of metal.

11. An escape device according to claim 1, wherein the disk plates and reel shaft are formed of plastic.

12. An escape device according to claim 1, wherein the casing housing includes a short cylindrical bore which forms a circumferential annular border which in use supportingly holds the reel.

13. An escape device according to claim 12, wherein the reel shaft ends terminate at the respective disk plates.

* * * * *